US007415918B2

(12) United States Patent
Paul

(10) Patent No.: US 7,415,918 B2
(45) Date of Patent: Aug. 26, 2008

(54) FUME EXTRACTOR

(75) Inventor: Lothar Alwin Paul, Pretoria (ZA)

(73) Assignee: Denel (Pty) Ltd, Pretoria (ZA)

( * ) Notice: Subject to any disclaimer, the term of this patent is extended or adjusted under 35 U.S.C. 154(b) by 330 days.

(21) Appl. No.: 10/562,262

(22) PCT Filed: Jun. 30, 2004

(86) PCT No.: PCT/IB2004/051060

§ 371 (c)(1),
(2), (4) Date: Apr. 27, 2006

(87) PCT Pub. No.: WO2005/003674

PCT Pub. Date: Jan. 13, 2005

(65) Prior Publication Data

US 2007/0006719 A1 Jan. 11, 2007

(30) Foreign Application Priority Data

Jul. 2, 2003 (ZA) ..... 2003/5148

(51) Int. Cl.
*B64D 1/04* (2006.01)
*F41F 5/00* (2006.01)

(52) U.S. Cl. ..... 89/1.2; 89/14.05; 89/14.1; 89/14.2; 89/14.4

(58) Field of Classification Search ..... 89/1.2, 89/14.05, 14.1, 14.2, 14.4
See application file for complete search history.

(56) References Cited

U.S. PATENT DOCUMENTS 2,807,986 A 10/1957 Howard et al.
3,377,918 A 4/1968 Austin, Jr. et al.
5,109,748 A 5/1992 Bertiller et al.
5,404,789 A 4/1995 Haas

OTHER PUBLICATIONS

International Search Report for PCT/IB2004/051060 dated Aug. 26, 2004.
International Preliminary Report on Patentability for PCT/IB2004/051060 dated Oct. 6, 2005.

*Primary Examiner*—Kimberly D Nguyen
*Assistant Examiner*—Jonathan C Weber
(74) *Attorney, Agent, or Firm*—Nixon & Vanderhye P.C.

(57) ABSTRACT

This invention relates to a fume extractor (10) for extracting fumes from a bore (12) of a barrel (14) of a gun and comprising an annular main reservoir (16); an annular inlet reservoir (18); and an annular auxiliary reservoir (20), all concentrically surrounding the barrel (14) and being in communication with each other and the bore (12). The inlet reservoir (18) is sandwiched between the main reservoir (16) and the barrel (14). The auxiliary reservoir (20) is sandwiched between the main reservoir (16) and the barrel (14) and is located adjacent the inlet reservoir (18) on a muzzle brake end thereof. The arrangement is such that the main reservoir (16) is pressurized when the gun is fired and such that the fumes in the bore (12) are extracted by the release of pressure in the main and auxiliary reservoirs (16) and (20), after the projectile has left the barrel (14). The communication between the inlet reservoir (18) and main reservoir (16) consists of plurality of ports (24) distributed circumferentially each port being provided with a check valve (30).

18 Claims, 6 Drawing Sheets

FUME EXTRACTOR

This application is the US national phase of International Application No. PCT/IB2004/051060 filed 30 Jun. 2004, which designated the U.S. and claims priority to South African Application No. 2003/5148, filed 2 Jul. 2003, the entire contents of each of which are incorporated herein by reference.

INTRODUCTION AND BACKGROUND TO THE INVENTION

This invention relates to a fume extractor for a barrel of a gun, and to a barrel and a gun provided with such a fume extractor.

A known fume extractor (such as the one disclosed in U.S. Pat. No. 5,404,789) for extracting fumes from the bore of a barrel of a gun, after a shot has been fired, comprises a main reservoir and an auxiliary reservoir, both surrounding the barrel, with the auxiliary reservoir located between said main reservoir and the breech end of the tube. A first set of ports, which are slanted towards the muzzle end of the bore, provides communication between the main reservoir and the bore while a second set of ports, which are perpendicular to the bore, provides communication between the bore and the auxiliary reservoir. A set of check valves provides communication between the auxiliary reservoir and the main reservoir, when the pressure in the main reservoir is less than that of the auxiliary reservoir.

In use, when a shot is fired, owing to the pressure difference between the bore and the reservoir, the main and auxiliary reservoirs are charged or pressurised by fumes passing through the two sets of ports from the bore into the main and auxiliary reservoirs. The main reservoir is thus pressurised via the said first set of ports, as well as from the auxiliary reservoir via the set of check valves.

When the projectile leaves the barrel, there is a pressure drop in the bore, so the set of check valves closes and the pressure in the main reservoir is released by blowing the fumes back into the bore via the first set of ports in the direction of the muzzle brake, thus to extract the fumes from the bore.

A first disadvantage is that, owing to the fact that the known fume extractor has only two reservoirs; the resultant extraction is a rapid discharge rather than an extended discharge. In the case of a rapid discharge, the fumes are insufficiently extracted, leading to fumes entering the turret of the gun to the detriment of the operators thereof.

Another disadvantage of the known fume extractor is that it is of insufficient capacity to sufficiently cool down the fumes before reaching the check valves when the reservoirs are charged. The result is that the check valves are damaged by the high temperature and the acceleration or deceleration of the fumes. The check valves therefore eventually disintegrate and deform.

Yet another disadvantage of the known fume extractors is that the attachment thereof to the barrel, makes it very difficult to remove the fume extractor from the barrel for maintenance purposes, for example when the check valves have to be replaced.

OBJECT OF THE INVENTION

It is therefore an object of the present invention to provide a fume extractor for a barrel of a gun, and a barrel and a gun provided with such a fume extractor with which the aforesaid disadvantages can be overcome or at least minimised.

SUMMARY OF THE INVENTION

According to the invention there is provided a fume extractor for extracting fumes from a bore of a barrel of a gun comprising:

a main reservoir surrounding the said barrel;

an inlet reservoir also surrounding the barrel and communicating with the bore of the barrel via a first set of ports and with the main reservoir via a second set of ports; and an auxiliary reservoir also surrounding the barrel of the gun and communicating with the main reservoir via a third set of ports and with the bore of the barrel via a fourth set of ports, the arrangement being such that the main reservoir is pressurised via both the inlet and auxiliary reservoirs when the gun is fired and further such that the fumes in the barrel are extracted by the release of pressure in the main and auxiliary reservoirs via the fourth set of ports.

Further according to the invention, each port of the second set is provided with a check valve, the arrangement being such that the check valves allow passing of the fumes from the inlet reservoir to the main reservoir via the second set of ports, but restricts reverse flow of the fumes from the main reservoir to the inlet reservoir.

The inlet reservoir may be sandwiched between the main reservoir and the barrel of the gun.

The auxiliary reservoir may also be sandwiched between the main reservoir and the barrel of the gun and may be located adjacent the inlet reservoir on a muzzle brake end thereof.

The first set of ports may be a plurality of ports distributed circumferentially around the barrel and may extend perpendicular to the longitudinal axis of the barrel.

The fourth set of ports may also be a plurality of ports distributed circumferentially around the barrel and may slant radially outwardly in the direction of a muzzle brake of the gun.

The inlet and auxiliary reservoirs may be partly defined by a first tubular sleeve having end walls; and a separating wall, which separates the inlet and auxiliary reservoirs.

The first tubular sleeve may concentrically surround the barrel, with the end and separating walls sealingly abutting the outside of the barrel.

An O-ring may be provided between the first tubular sleeve and the barrel to create an airtight seal between them.

The main reservoir may be partly defined by a second tubular sleeve concentrically surrounding the first tubular sleeve, as well as by two annular end caps for sealingly engaging the second tubular sleeve and the first tubular sleeve.

An O-ring may be provided between the first tubular sleeve and each end cap to create an airtight seal between them.

An O-ring may be located between the second tubular sleeve and each end cap to create an airtight seal between the second tubular sleeve and each end cap.

A retaining ring for retaining the fume extractor in position on the barrel may be releasably connectable to the barrel.

The retaining ring may be connected to the barrel intermediate its ends, towards the muzzle brake end thereof and to one end of the fume extractor.

The retaining ring may be provided with an internal screw thread for screwing onto a complimentary thread provided on the outside of the barrel.

The retaining ring may be provided with a set of holes, for receiving urging screws, for urging the fume extractor in a direction towards the retaining ring for removal of the fume extractor from the barrel.

According to a second aspect of the invention there is provided a barrel of a gun having a fume extractor according to the first aspect of the invention.

According to a third aspect of the invention there is provided a gun having a fume extractor according to the first aspect of the invention.

BRIEF DESCRIPTION OF THE DRAWINGS

The invention will now be described further by way of a non-limiting example with reference to the accompanying drawings wherein.

DESCRIPTION OF A PREFERRED EMBODIMENT OF THE INVENTION

Figure 1:
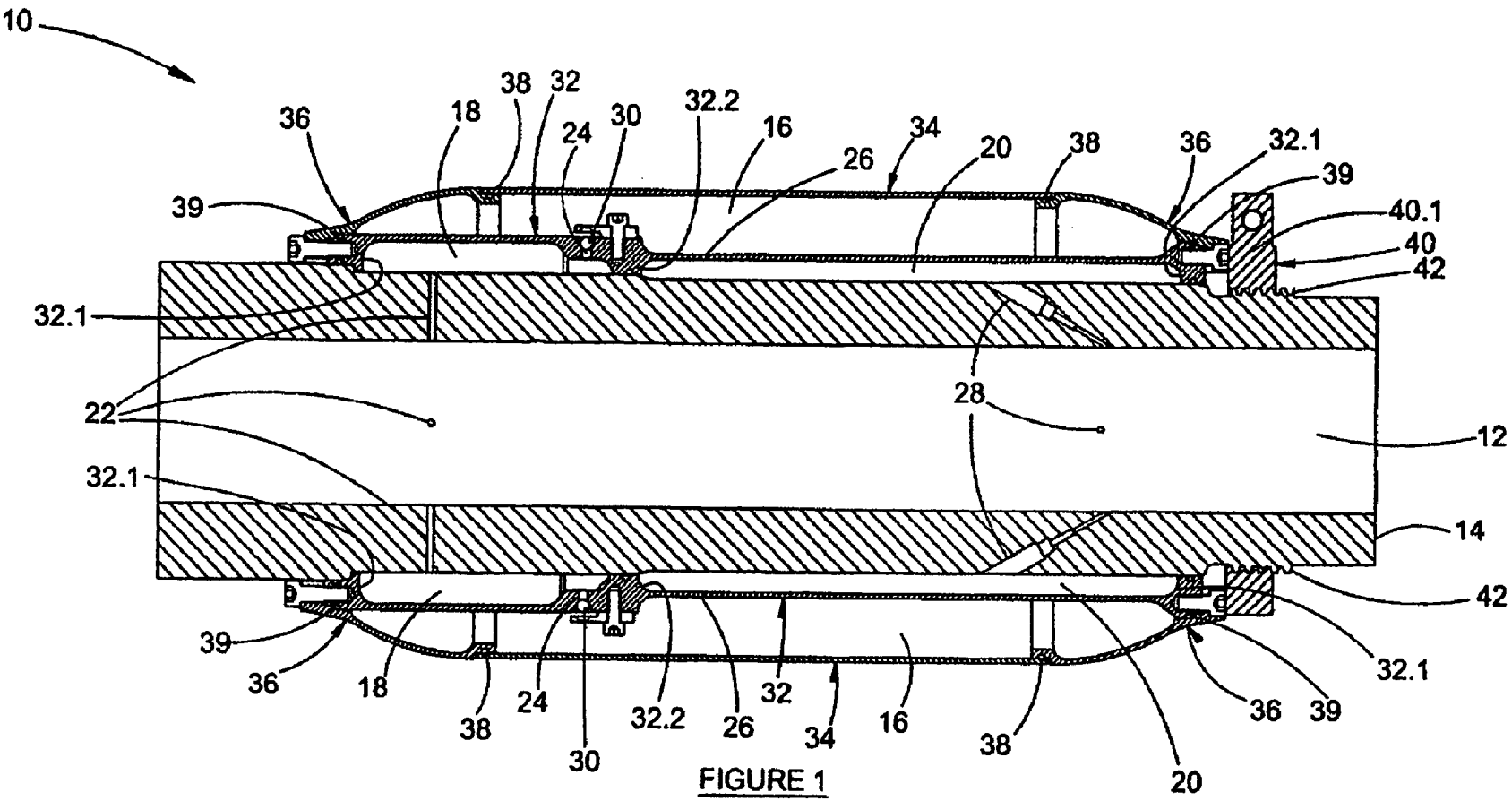
FIG. 1 is a longitudinal-sectional side view of a fume extractor according to the invention, surrounding a barrel of a gun, for extracting fumes from the said barrel.

Referring to the drawings, a fume extractor according to a preferred embodiment of the invention, for extracting fumes from a bore 12 of a barrel 14 of a gun (not shown) is generally designated by reference numeral 10.

Figure 2:
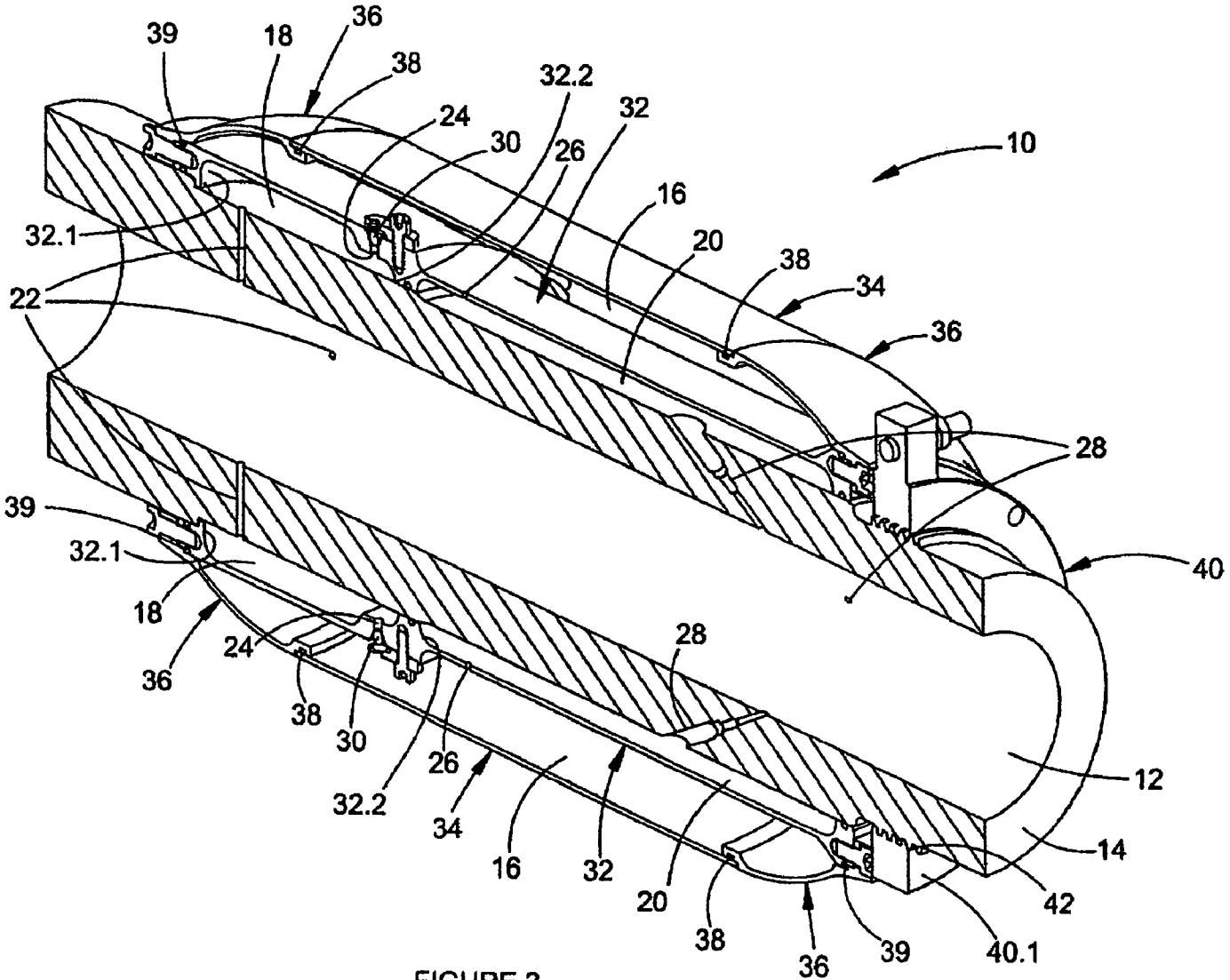
FIG. 2 is a perspective view of the fume extractor of FIG. 1.

Referring to FIGS. 1 and 2, the fume extractor 10 comprises an annular main reservoir 16; an annular inlet reservoir 18; and an annular auxiliary reservoir 20, all concentrically surrounding the barrel 14. The inlet reservoir 18 communicates with the bore 12 via a first set of ports 22 and with the main reservoir via a second set of ports 24. The auxiliary reservoir 20 communicates with the main reservoir 16 via a third set of ports 26 and with the bore 12 of the barrel 14 via a fourth set of ports 28. The arrangement is such that the main reservoir 16 is pressurised via both the inlet and auxiliary reservoirs 18 and 20 respectively, when the gun is fired. The arrangement is further such that the fumes in the barrel 14 are extracted by the release of pressure in the main and auxiliary reservoirs 16 and 20 respectively, via the fourth set of ports 28, after the projectile (not shown) has left the barrel 14.

Each port of the second set of ports 24 is provided with a check valve 30, for allowing passing of the fumes from the inlet reservoir 18 to the main reservoir 16 via the second set of ports 24, while restricting reverse flow of the fumes from the main reservoir 16 to the inlet reservoir 18.

The inlet reservoir 18 is sandwiched between the main reservoir 16 and the barrel 14 of the gun. The auxiliary reservoir 20 is also sandwiched between the main reservoir 16 and the barrel 14 of the gun and is located adjacent the inlet reservoir 18 on a muzzle brake end thereof.

The first set of ports 22 is a plurality of ports distributed around the barrel 14 and extends perpendicular to the barrel 14. The fourth set of ports 28 is a plurality of ports distributed around the barrel 14 and slant in the direction of the muzzle brake of the gun.

Figure 3:
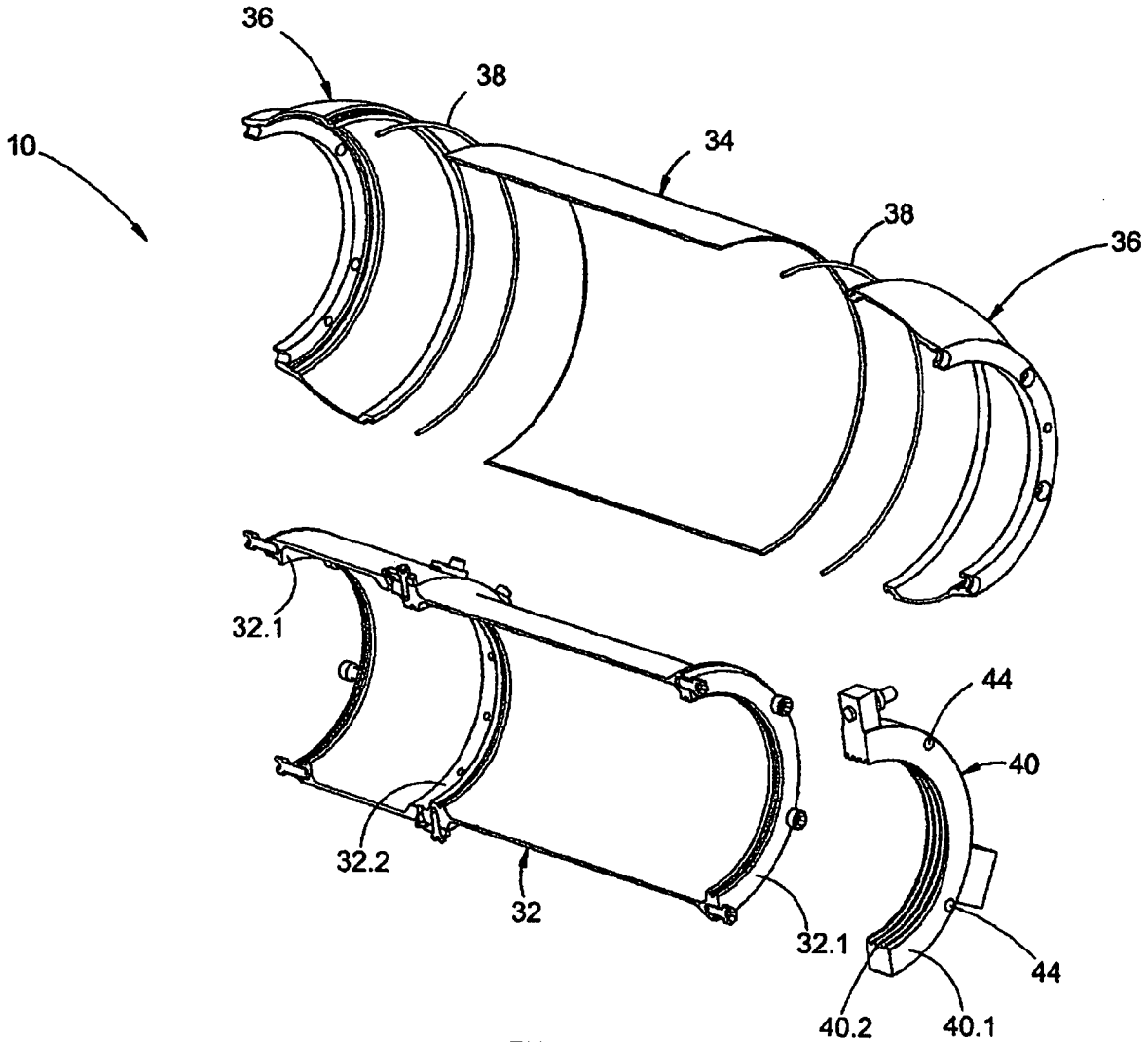
FIG. 3 is a disassembled view of the fume extractor of FIGS. 1 and 2.
Figure 4:
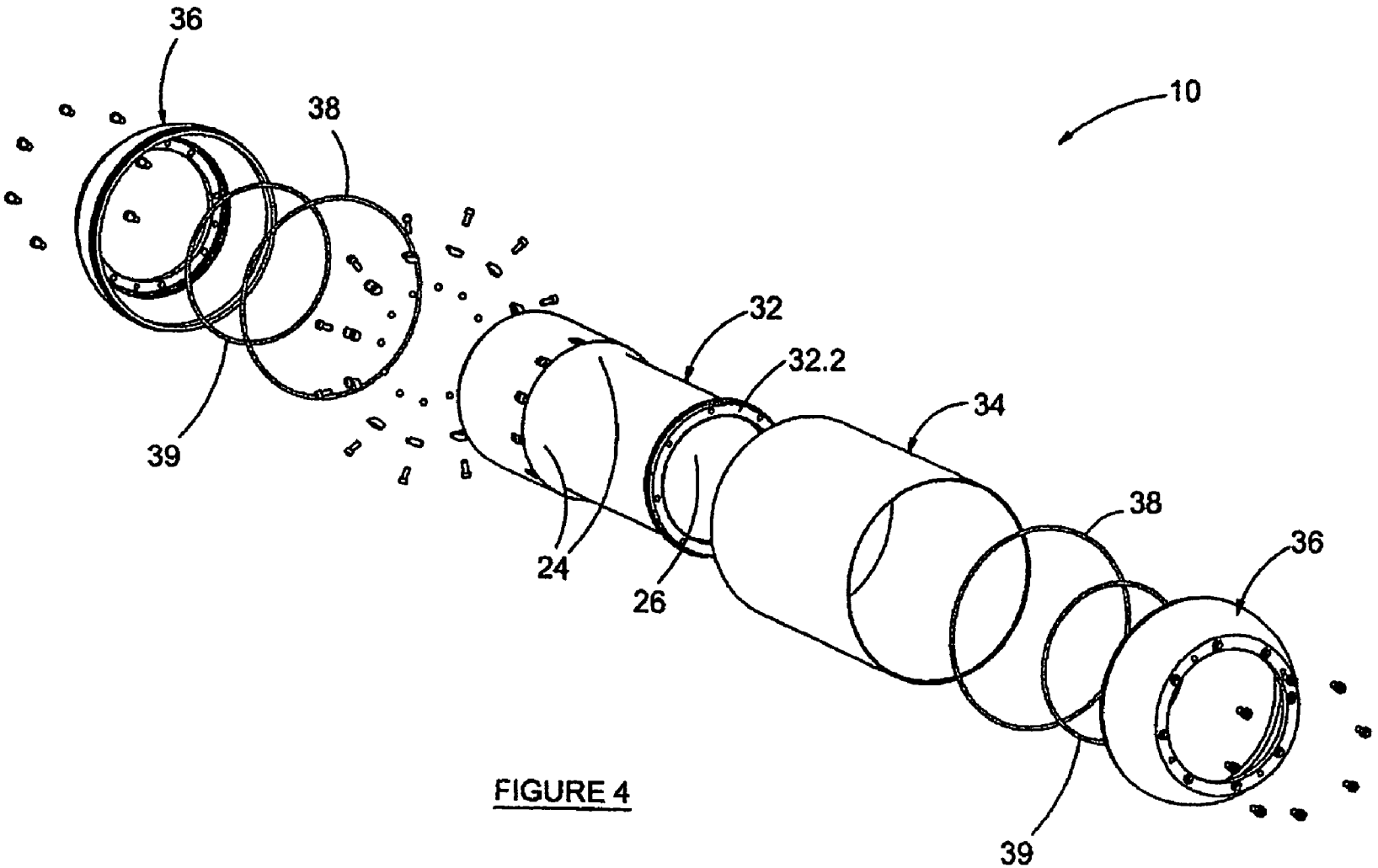
FIG. 4 is an exploded perspective view of the fume extractor.

Referring particularly to FIGS. 3 and 4, the inlet and auxiliary reservoirs 18 and 20 respectively, are partly defined by a first tubular sleeve 32 having two end walls 32.1 and a separating wall 32.2, which separates the inlet and auxiliary reservoirs 18 and 20 respectively. The first tubular sleeve 32 concentrically surrounds the barrel 14, with the end and separating walls 32.1 and 32.2 sealingly abutting the outside of the barrel 14.

The main reservoir 16 is partly defined by a second tubular sleeve 34 concentrically surrounding the first tubular sleeve 32, as well as by two annular end caps 36 for sealingly engaging the second tubular 34 sleeve and the first tubular sleeve 32.

An O-ring 38 is located between the second tubular sleeve 34 and each end cap 36 to create an airtight seal between the second tubular sleeve 34 and each end cap 36. O-rings 39 are also located between the first tubular sleeve 32 and the barrel 14 and between the first tubular sleeve 32 and each end cap 36.

Figure 5:
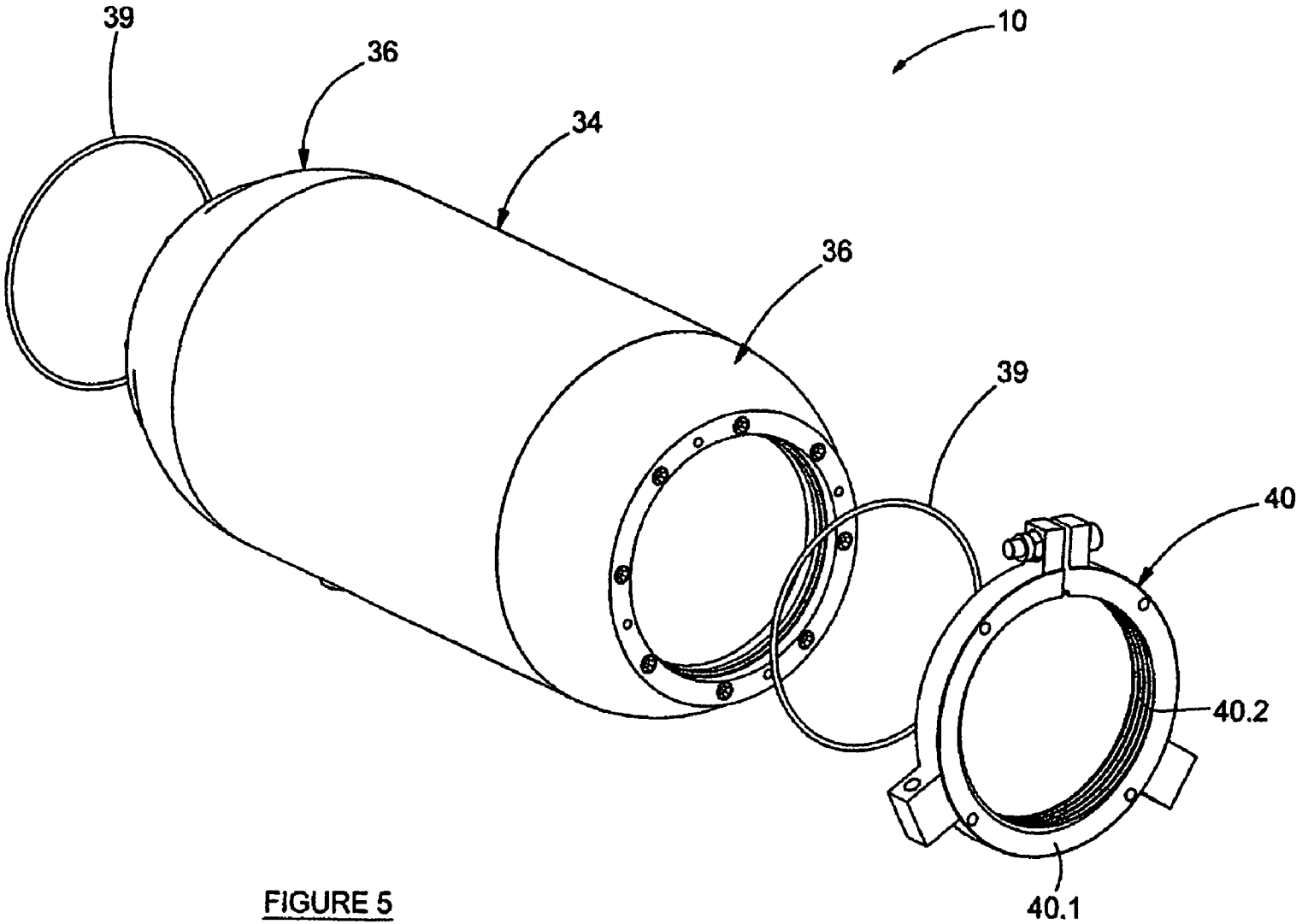
FIG. 5 is the same as that of FIG. 4 with a central portion of the fume extractor assembled.
Figure 6:
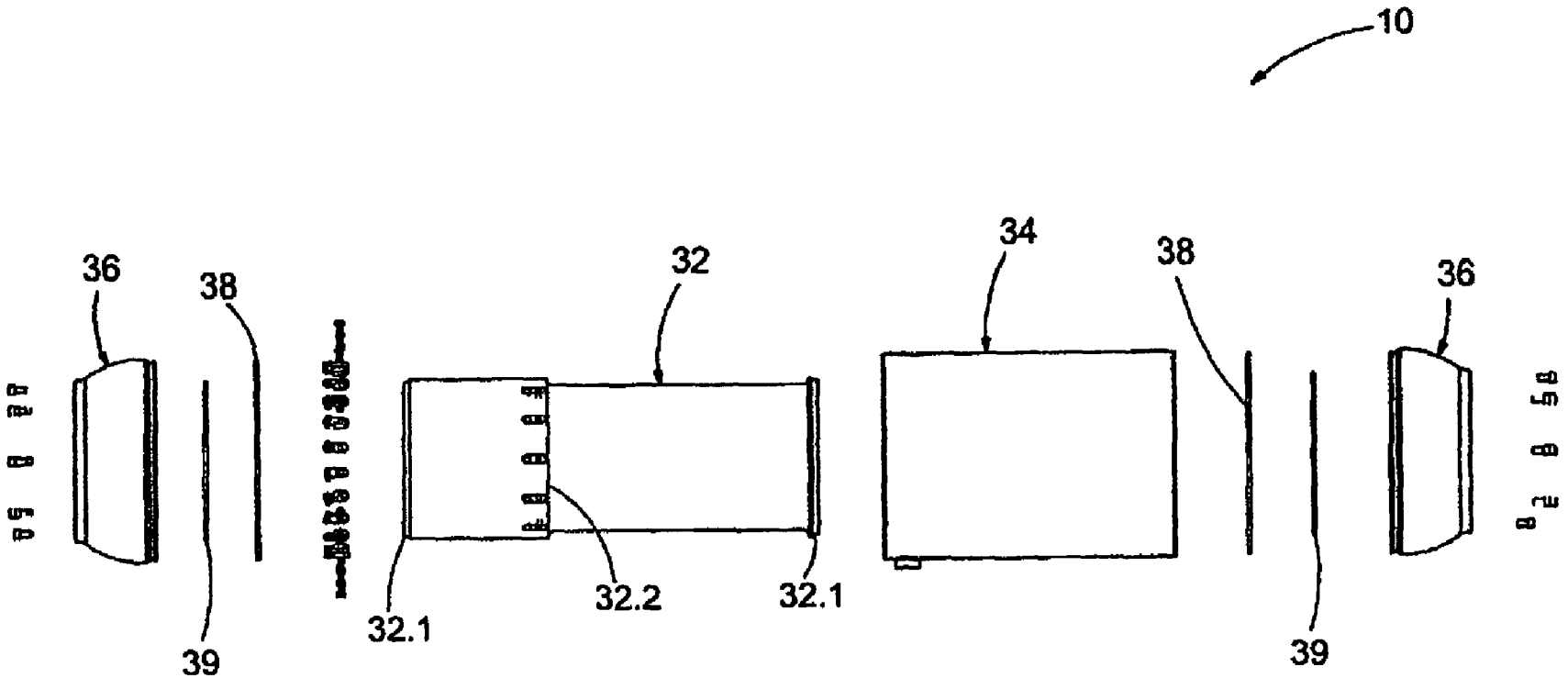
FIG. 6 is a side view of FIG. 4.

Referring particularly to FIG. 5, a retaining ring 40 for retaining the fume extractor 10 in position on the barrel 14 is a split band 40.1, which is connected to the barrel 14 towards the muzzle brake side thereof and abuts the fume extractor 10. The retaining ring 40 defines an internal screw thread 40.2 for screwing onto a complimentary thread 42 provided on the outside of the barrel 14. The retaining ring 40 is provided with a set of holes 44, for receiving urging screws (not shown), for urging the fume extractor 10 in a direction towards the retaining ring 40 for removal of the fume extractor 10 from the barrel 14.

In use, when a shot is fired, combustion of the explosive charge pressurises the bore 12 of the barrel 14 with fumes at high pressure and temperature. Subsequently and owing to the pressure difference between the bore 12 and the inlet and auxiliary reservoirs 18 and 20, the fumes pass into the inlet and auxiliary reservoirs 18 and 20 from the bore 12 via the first and fourth sets of ports 22 and 28 respectively. Thereafter, owing to the pressure difference between the inlet and auxiliary reservoirs 18 and 20 and the main reservoir 16, fumes pass into the main reservoir 16 from the inlet and auxiliary reservoirs 18 and 20 via the second and third sets of ports 24 and 26.

After the projectile leaves the barrel 14, there is a pressure drop in the bore 12, resulting in a pressure difference between the main and auxiliary reservoirs 16 and 20 and the bore 12, which promotes the release of pressure from the main and auxiliary reservoirs 16 and 20 into the bore 12, thus to blow the fumes out of the muzzle end of the barrel 14 and therefore purging the bore 12 of the remaining fumes. The check valves 30 in the second set of ports 24 close, thus restricting reverse flow along the second set of ports 24.

It has been found that the fume extractor 10, according to the present invention, allows the fumes entering the inlet reservoir 18 to cool down sufficiently before reaching the check valves 30, so that they are not damaged. It was further found that owing to the provision of an auxiliary reservoir 20, the fumes are discharged from the main and auxiliary reservoirs over an extended period rather than rapidly, therefore allowing the fumes to be effectively extracted from the bore 12 and limiting the fumes entering the turret.

It has yet further been found that the fume extractor 10 can relatively easily be removed from the barrel 14 of the gun for maintenance purposes, owing to the retaining ring 40 aiding in such removal, when using the urging screws.

It will be appreciated that variations in detail are possible with a fume extractor for a barrel of a gun, and a barrel and a gun provided with such a fume extractor according to the invention without departing from the scope of the appended claims.

The invention claimed is:

1. A fume extractor for extracting fumes from a bore of a barrel of a gun comprising a main reservoir surrounding the said barrel; an inlet reservoir also surrounding the barrel and communicating with the bore of the barrel via a first set of ports and with the main reservoir via a second set of ports; and an auxiliary reservoir also surrounding the barrel of the gun and communicating with the main reservoir via a third set of ports and with the bore of the barrel via a fourth set of ports, the arrangement being such that the main reservoir is pressurised via both the inlet and auxiliary reservoirs when the gun is fired and further such that the fumes in the barrel are extracted by the release of pressure in the main and auxiliary reservoirs via the fourth set of ports.

2. A fume extractor according to claim 1 wherein each port of the second set is provided with a check valve, the arrangement being such that the check valves allow passing of the fumes from the inlet reservoir to the main reservoir via the second set of ports, but restricts reverse flow of the fumes from the main reservoir to the inlet reservoir.

3. A fume extractor according to claim 2 wherein the inlet reservoir is sandwiched between the main reservoir and the barrel of the gun.

4. A fume extractor according to claim 3 wherein the auxiliary reservoir is also sandwiched between the main reservoir and the barrel of the gun and is located adjacent the inlet reservoir on a muzzle brake end thereof.

5. A fume extractor according to claim 4 wherein the first set of ports is a plurality of ports distributed circumferentially around the barrel and extending perpendicular to the longitudinal axis of the barrel.

6. A fume extractor according to claim 5 wherein the fourth set of ports is also in the form of a plurality of ports distributed circumferentially around the barrel and which slant, radially outwardly, in the direction of a muzzle brake of the gun.

7. A fume extractor according to claim 1 wherein the inlet and auxiliary reservoirs are partly defined by a first tubular sleeve having end walls; and a separating wall, which separates the inlet and auxiliary reservoirs.

8. A fume extractor according to claim 7 wherein the first tubular sleeve concentrically surrounds the barrel, with the end and separating walls sealingly abutting the outside of the barrel.

9. A fume extractor according to claim 8 wherein an O-ring is provided between the first tubular sleeve and the barrel to create an airtight seal between them.

10. A fume extractor according to claim 7 wherein the main reservoir is partly defined by a second tubular sleeve concentrically surrounding the first tubular sleeve, as well as by two annular end caps for sealingly engaging the second tubular sleeve and the first tubular sleeve.

11. A fume extractor according to claim 10 wherein an O-ring is provided between the first tubular sleeve and each end cap to create an airtight seal between them.

12. A fume extractor according to claim 11 wherein an O-ring is located between the second tubular sleeve and each end cap to create an airtight seal between the second tubular sleeve and each end cap.

13. A fume extractor according to claim 1 provided with a retaining ring for retaining the fume extractor in position on the barrel, the retaining ring being releasably connectable to the barrel.

14. A fume extractor according to claim 13 wherein the retaining ring is connected to the barrel intermediate its ends, towards the muzzle brake end thereof and to one end of the fume extractor.

15. A fume extractor according to claim 14 wherein the retaining ring is provided with an internal screw thread for screwing onto a complimentary thread provided on the outside of the barrel.

16. A fume extractor according to claim 15 wherein the retaining ring is provided with a set of holes, for receiving urging screws, for urging the fume extractor in a direction towards the retaining ring for removal of the fume extractor from the barrel.

17. A barrel of a gun having a fume extractor according to claim 1.

18. A gun having a fume extractor according to claim 1.

* * * * *